US006935571B2

(12) United States Patent
Van Der Merwe

(10) Patent No.: US 6,935,571 B2
(45) Date of Patent: Aug. 30, 2005

(54) AIR DIFFUSER

(75) Inventor: Gustav Johann Van Der Merwe, Strand (ZA)

(73) Assignee: Rickard Air Diffusion (Proprietary ) Limited, Ottery (ZA)

( * ) Notice: Subject to any disclaimer, the term of this patent is extended or adjusted under 35 U.S.C. 154(b) by 158 days.

(21) Appl. No.: 10/449,724

(22) Filed: May 30, 2003

(65) Prior Publication Data

US 2004/0035945 A1 Feb. 26, 2004

(30) Foreign Application Priority Data

May 30, 2002 (ZA) ..... 2001/9879

(51) Int. Cl.[7] ..... F24F 7/06
(52) U.S. Cl. ..... 236/49.5; 236/91 E; 454/258
(58) Field of Search ..... 236/49.5, 99 E, 236/91 E, 101 B; 454/258

(56) References Cited

U.S. PATENT DOCUMENTS 5,647,532 A 7/1997 De Villiers et al. ..... 236/49.5
5,860,592 A * 1/1999 Dozier et al. ..... 236/49.3
6,176,435 B1 * 1/2001 Nielsen ..... 236/49.5
6,254,010 B1 7/2001 De Villiers ..... 236/49.5
6,702,187 B2 * 3/2004 van der Merwe ..... 236/49.5
2003/0146291 A1 * 8/2003 Hunka ..... 236/49.5

* cited by examiner

*Primary Examiner*—William E. Tapolcai
(74) *Attorney, Agent, or Firm*—Ladas & Parry LLP

(57) ABSTRACT

A diffuser comprising a casing (10), a first temperature sensitive element (32) for sensing room temperature variations and including a body and a piston which move relatively to one another in response to temperature variations, a second temperature sensitive element (38), an airflow control structure including a damper blade (72) having a first position in which airflow is restricted and a second position in which a greater air flow is permitted, and an actuator (18) for displacing the blade (72) between said first and second positions in response to room temperature variations, the actuator (18) including a cam follower (56) which is displaced by the first element (32) as the piston and body of the first element (32) move relatively to one another with room temperature variations, and a spindle (36) connecting the cam (56) to the second element (38).

13 Claims, 15 Drawing Sheets

AIR DIFFUSER

FIELD OF THE INVENTION

THIS INVENTION relates to diffusers.

BACKGROUND TO THE INVENTION

The term "diffuser" is used to designate those devices which, in air conditioning systems, are employed for the purpose of regulating flow of air, which may be heated air or cooled air, from air conditioning ducting into a room.

Various conditions occur in an air conditioned room depending on whether the outside temperature is above that at which the room is to be maintained or below that at which the room is to be maintained.

In "Summer" conditions cooled air is fed from the air conditioning plant to the diffuser. If the room temperature is below that at which it is to be maintained, because cooled air has previously been fed in, then the diffuser must remain closed to prevent further cooled air entering the room.

As the room heats up a room temperature sensing element detects this condition and opens the diffuser to allow more cooled air into the room. The diffuser thus opens and closes as the room temperature varies.

In "Winter" conditions heated air is fed to the diffuser. If the room is above the requisite temperature, because heated air has previously been fed into the room, the diffuser must remain closed to prevent further heated air from entering the room. As the room cools down, the room temperature sensing element detects this and opens the diffuser to allow more heated air in. The diffuser consequently opens and closes as the room temperature varies.

In the specification of our South African patent 96/4791 (U.S. Pat. No. 5,647,534 and Australian Patent No. 700908) there is disclosed a diffuser which has a single room temperature sensing element which closes a diffuser when the room is too cold (in Summer conditions) and also closes the diffuser when the room is too hot (in Winter conditions). This avoids the use of complex constructions involving two or more room temperature sensing elements. The present invention seeks to provide an improved diffuser using a single room temperature sensing element.

BRIEF DESCRIPTION OF THE INVENTION

According to one aspect of the present invention there is provided a diffuser for controlling flow of air in an air conditioning system, the diffuser including a first temperature sensitive element for sensing room temperature variations and including a body and a piston which move relatively to one another in response to temperature variations, a second temperature sensitive element for sensing supply duct temperature variations and including a body and a piston which move relatively to one another in response to temperature variations, an airflow control structure including a damper blade having a first position in which airflow is restricted and a second position in which a greater air flow is permitted, and an actuator for displacing said blade between said first and second positions in response to room temperature variations, said actuator including a cam follower, a cam having first and second cam surfaces and which is displaced by said first element as the piston and body of the first element move relatively to one another with room temperature variations, and means connecting said cam to said second element so that said cam is displaced between a first position in which said first surface and follower co-operate when cooled air is flowing in the duct and a second position in which said second surface and follower co-operate when heated air is flowing in the duct, the arrangement being such that in use said first cam surface displaces the damper blade in the direction which increases air flow as the temperature to which the first element is subjected increases, and said second cam surface displaces the damper blade in the direction which increases air flow as the temperature to which the first element is subjected decreases.

In one form said blade is mounted for oscillatory movement about an axis, said cam follower being mounted for oscillatory movement about the same axis and extending on both sides of said axis, said first and second cam surfaces co-operating with surfaces of said follower which are on opposite sides of said axis. Preferably the diffuser comprises a pair of diffuser blades mounted for oscillating movement about parallel axes, there being two cam followers and the cam having two first surfaces and two second surfaces for co-operation with the two cam followers.

In a specific form of diffuser said cam comprises a web by means of which it is secured for movement with said first element, a flange extending downwardly from the web and having said first surfaces thereon and a pair of columns extending downwardly from the web and having said second surfaces thereon, the cam followers being between said first and second surfaces. To ensure that the cam moves in a straight line there can be a guide between said columns.

There can be pairs of damper blades on each side of the actuator, there being four cam followers each mounted to swing an associated damper blade when the cam moves with variations in the temperature to which said first element is subjected. In this form said cam comprises a depending flange along each edge of the web and pairs of columns extending downwardly from the flange.

To avoid the use of return springs the or each damper blade can be urged in one direction by its cam follower and move in the other direction under the influence of gravity and the force exerted on it by air flowing from the duct to the room.

To ensure that the first element is always at room temperature the diffuser can include a sleeve with said first element mounted in one end of the sleeve, there being means defining a first air flow path for feeding air from said duct into a room, means defining a second air flow path for feeding air from the other end of the sleeve to said first flow path, the second flow path leading into the first flow path, the arrangement of said first and second flow paths being such that air flowing in the first flow path draws air from the second flow path and the sleeve thereby causing a flow of room temperature air in said sleeve and across said first element.

In another form of diffuser each cam follower is in the damper form of a roller mounted on a roller carrier, there being spring means for holding the rollers against said cam surfaces. This form of diffuser preferably comprises a pair of damper blades mounted for oscillating movement about parallel axes, there being two cam followers and the cam having two first surfaces and two second surfaces for co-operation with the two cam followers. An advantageous form of cam comprises a plate having the cam surfaces on each of two opposed edges thereof, each first surface of the cam sloping downwardly and intersecting a respective vertical flat at the upper end of the respective flat, and each second surface of the cam sloping upwardly and intersecting the respective flat at the lower end thereof, the first surfaces converging in the direction away from the flats and the second surfaces converging in the direction away from the flats.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION OF THE DRAWINGS

Figure 1:
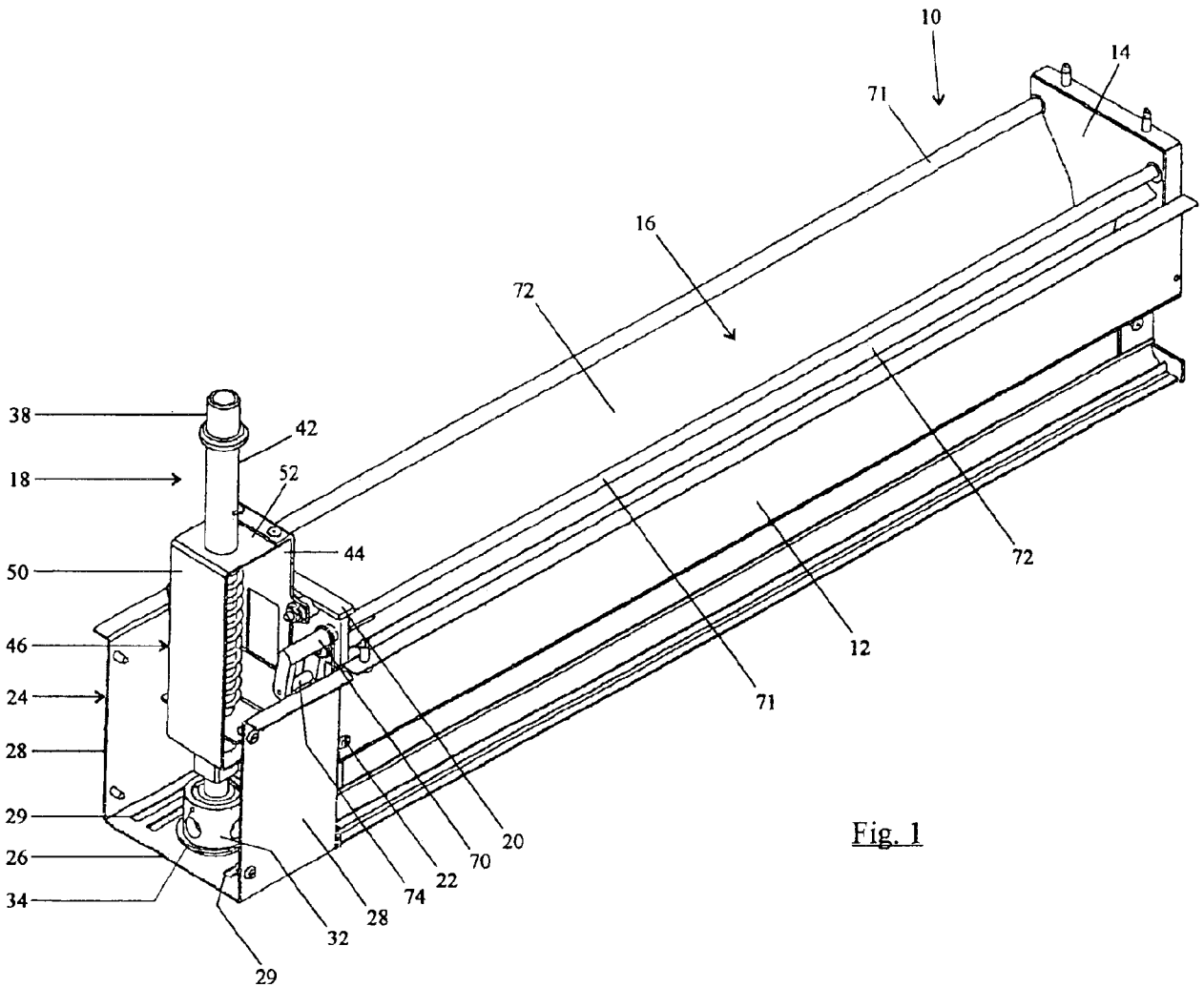
FIG. 1 is a pictorial view of a diffuser.

The diffuser illustrated in FIG. 1 has a casing 10 which comprises two parallel side plates 12 and a transverse plate 14 which closes one end of the casing 10. The casing 10 defines a chamber 16 into which heated or cooled air flows from an air duct (described in more detail hereinafter) to the underside of which the casing 10 is fitted.

An actuator, generally designated 18, is provided at the end of the casing 10 remote from the transverse plate 14.

The actuator 18 is separated from the chamber 16 by a plate 20, manufactured from a thermally insulating material, which fits between the two side plates 12 and is secured thereto by screws 22 passed through the side plates 12 and into the plate 20.

Figure 2:
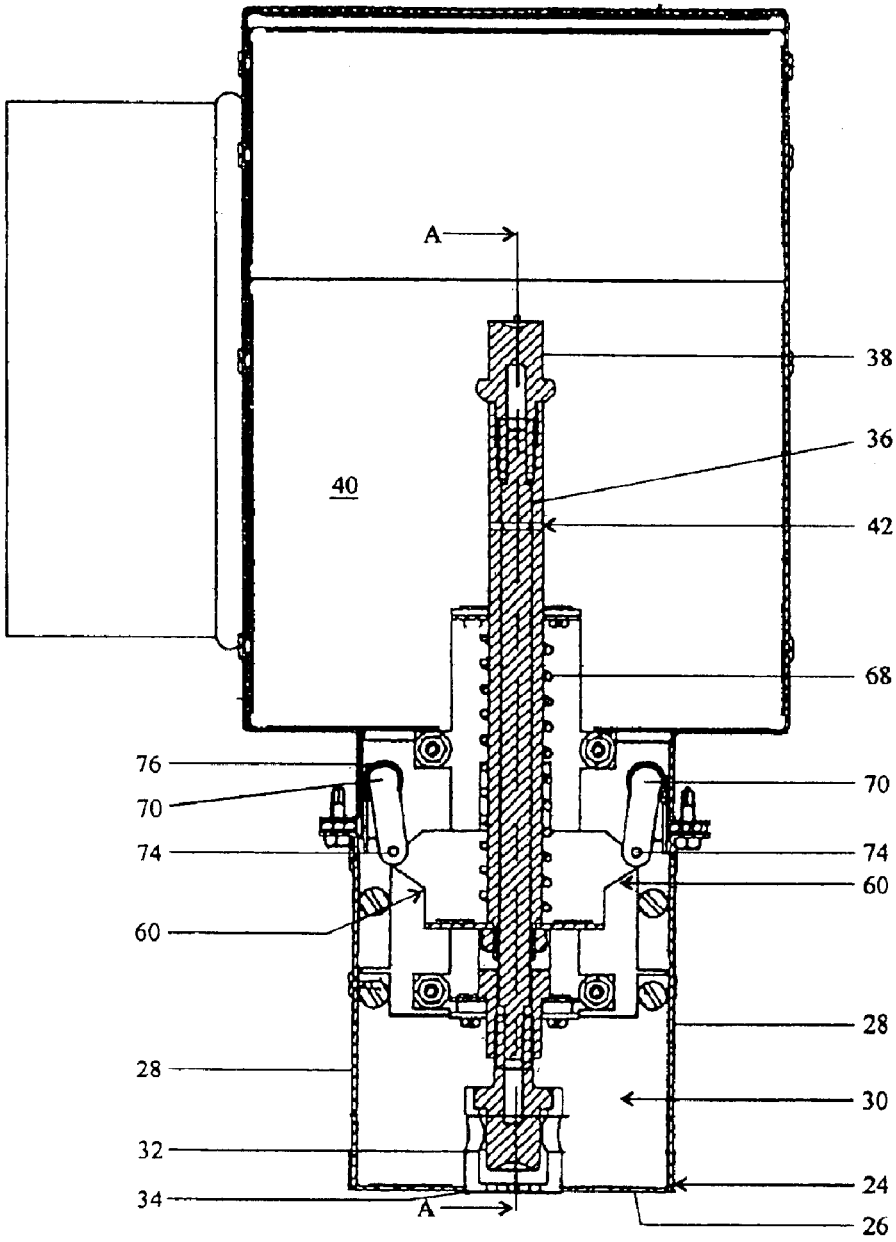
FIG. 2 is a vertical section through the actuator of the diffuser of FIG. 1, FIG. 2 being to a larger scale than FIG. 1.

A U-shaped cover 24 is secured to the end of the casing 10, the cover 24 comprising a horizontal bottom web 26 and two vertical flanges 28. Slots 29 are cut in the web 26 to permit air to flow from the room into a chamber 30 (see FIG. 2) in which a thermally sensitive element 32 is located. A hole 34 in the web 26 provides access to the element 32.

A spindle 36 is in contact with the piston of the element 32 and also with the piston of another thermally sensitive element 38. The element 38 is in an air duct designated 40. The element 38 is screwed into a tube 42.

Figure 5:
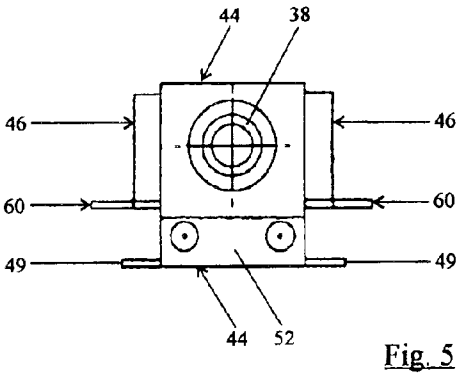
FIG. 5 is a top plan view of the actuator.
Figure 3:
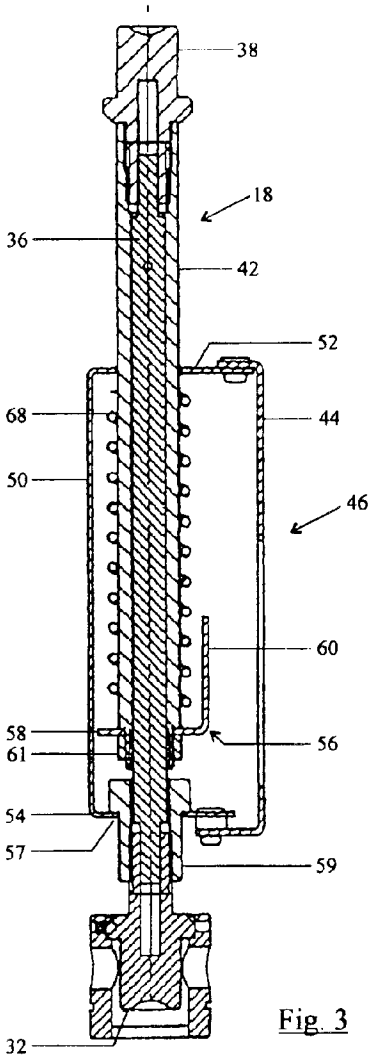
FIG. 3 is a vertical section along the line A—A of FIG. 2.
Figure 4:
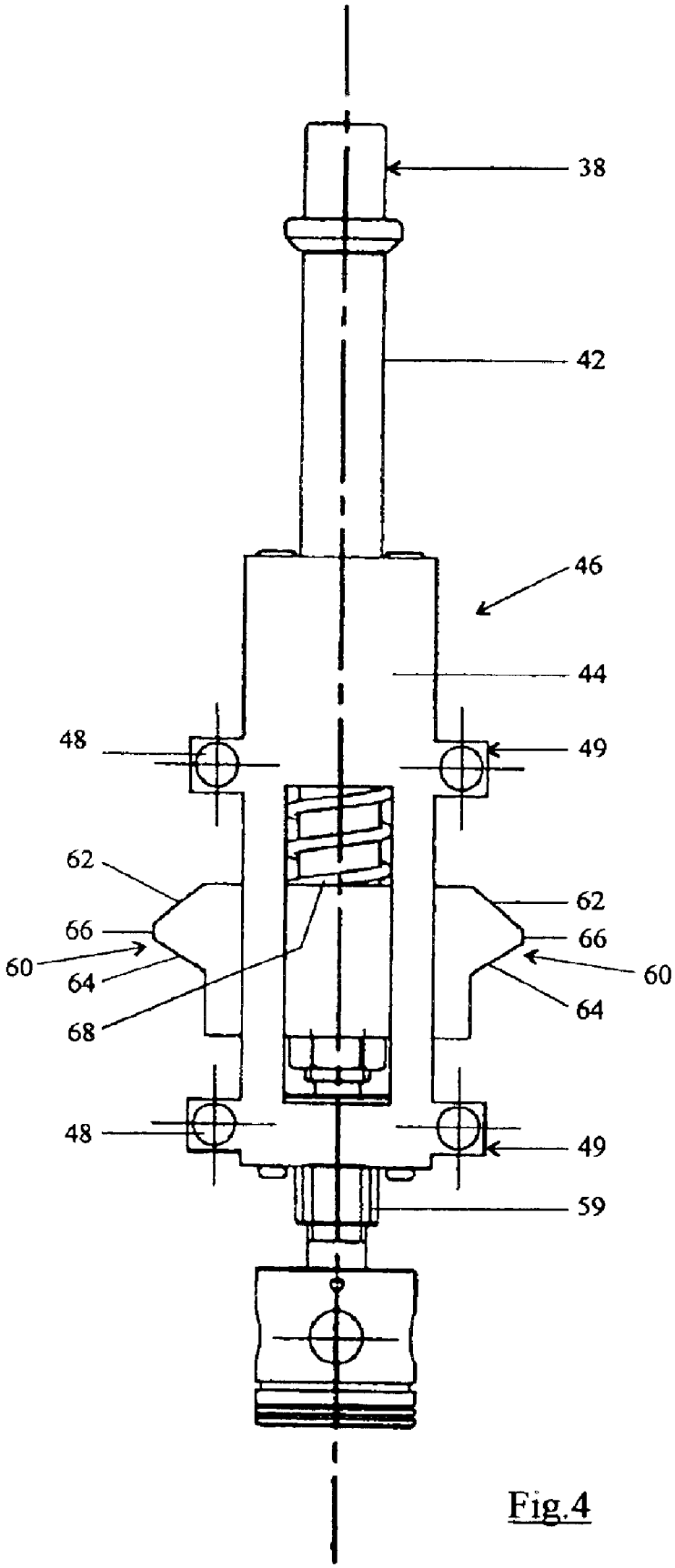
FIG. 4 is a front elevation of the actuator of FIG. 2.

One of the vertical flanges 44 (see specifically FIGS. 3, 4 and 5) of a two part bracket 46 is secured to the insulating plate 20 by screws 48 passed through tabs 49 protruding horizontally from the flange 44. The bracket 46 has a further flange 50, which extends parallel to the flange 44, as well as top and bottom webs 52, 54. The tube 42 and spindle 36 pass through the upper web 52. There is a hole 57 in the web 54 and a bush 59 is a tight fit in the hole 57. A cam 56 of right-angle shape, and having a horizontal web 58 and a vertical web 60, is carried by the tube 42.

The tube 42 terminates just below the level of the web 58 whereas the spindle 36 passes through the web 58 and into the bush 59. A nut 61 screwed onto the tube 42 fastens the flange 58 to the end of the tube 42. The thermally sensitive element 32 is screwed into the bush 59.

The web 60 has cam surfaces 62 and 64 (see particularly FIG. 4) on each side thereof. The surfaces 62 slope and are directed upwardly. The surfaces 64 also slope and are directed downwardly. Vertically extending flats 66 join the cam surfaces 62, 64.

A spring 68 bears on the upper surface of the web 58 and on the underside of the web 52 and presses the cam 56 and spindle 36 downwardly.

Roller carriers designated 70 (FIG. 1) are mounted on the ends of shafts 71 which pass through the insulating plate 20. The other ends of the shafts 71 are mounted on the transverse plate 14. The shafts 71 can turn on their longitudinal axes, the transverse plate 14 and the insulating plate 20 acting as pivotal mountings.

Damper blades 72 are carried by the shafts 71 and hang down in the casing 10. This is best seen in FIG. 1. The damper blades 72 slope inwardly within the chamber 16 so that, in the position shown in FIGS. 1 and 2, their lower edges are close to one another (see FIG. 6) to minimise air flow from the chamber 16 to the room.

The roller carriers 70 carry rollers 74 which run on the cam faces 62 and 64 and on the flat 66. Springs 76 rotate the shafts 71 and roller carriers 70 in the direction which presses the rollers 74 against the web 60.

Figure 6:
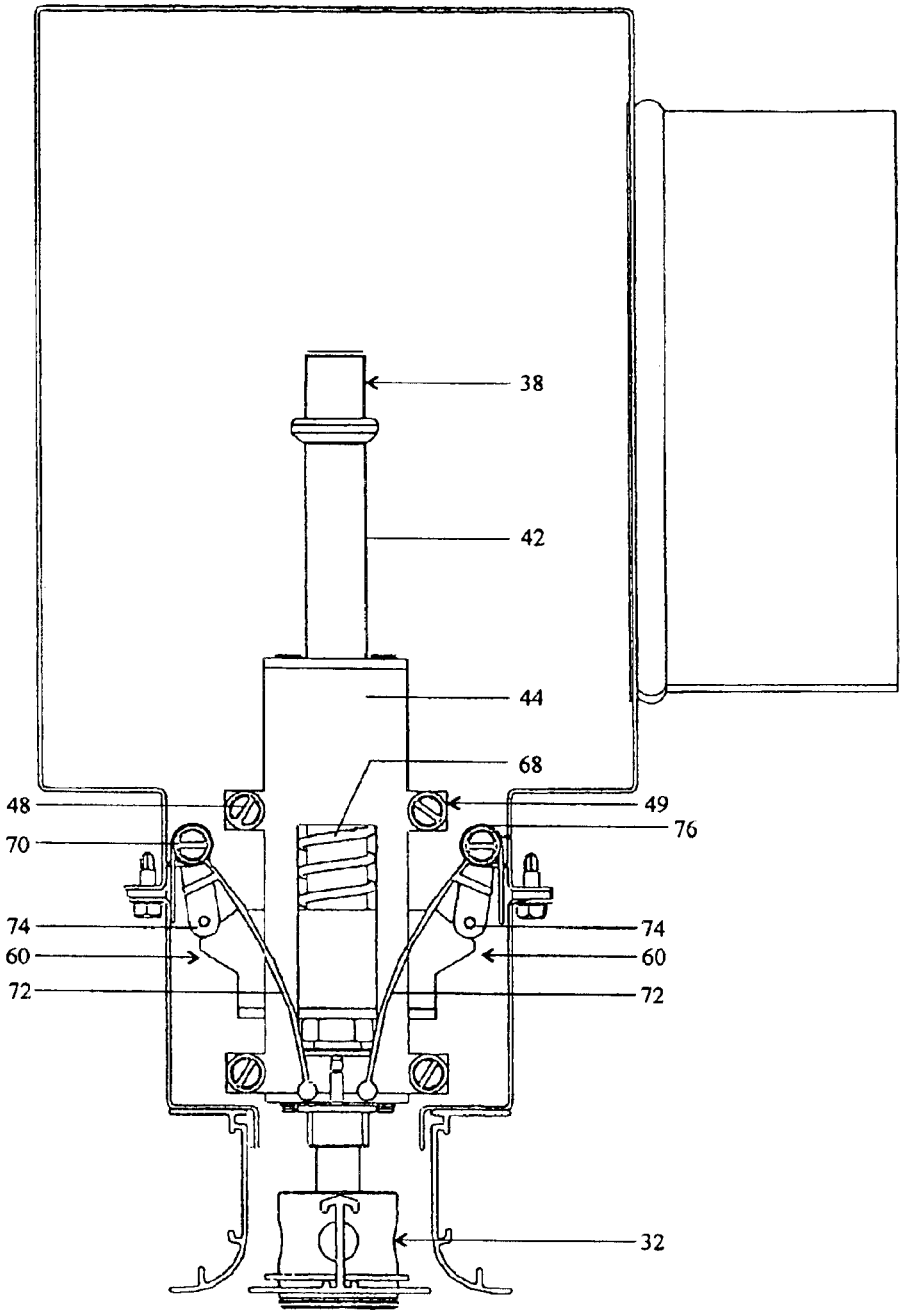
FIGS. 6 to 8 are elevations of the actuator and show the diffuser in different operative conditions.

The element 32 senses room temperature and the element 38 detects duct temperature. On the assumption that cooled air is flowing in the ducting 40, the piston of the element 38 is fully retracted. If it is further assumed that the room is cold, then the piston of the element 32 is also fully retracted, the wax in both elements 32, 38 having contracted and possibly solidified. In these conditions the diffuser is as shown in FIG. 6. The spring 68 presses on the upper surface of the flange 58 pushing the cam 56 downwardly with the spindle 36 to the maximum extent permitted by the structure.

As shown in FIG. 6, the rollers 74 bear on the downwardly sloping cam surfaces 62, and, in the position shown, the lower ends of the damper blades 72 are close to one another, thereby keeping air flow from the chamber 16 to the room to a minimum.

Figure 7:
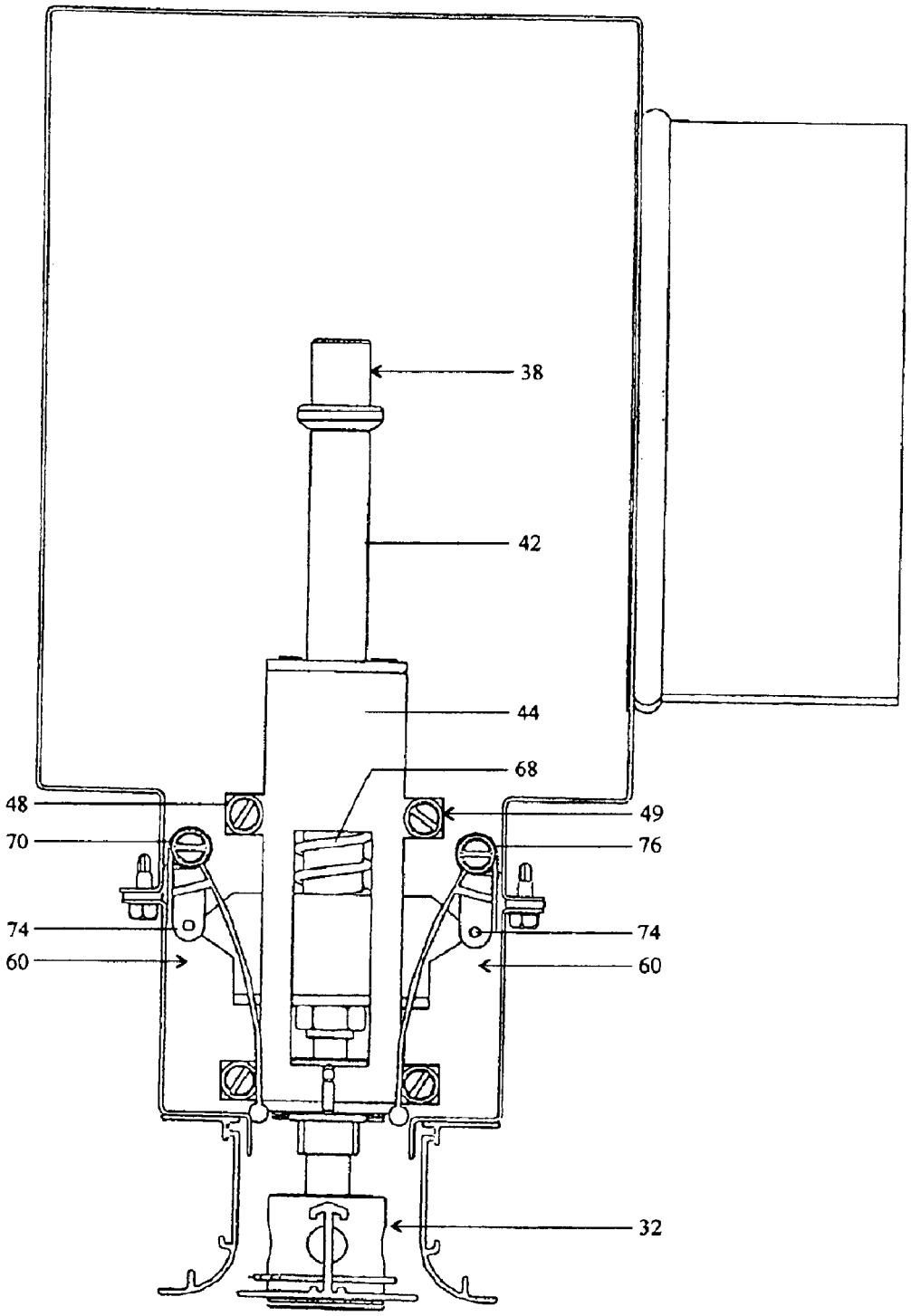

As the room warms up, the wax in the element 32 expands and an upward thrust is exerted on the spindle 36 by the piston of the element 32. The upper end of the spindle 36 is against the piston of the element 38 and the piston of the element 38 cannot, because of the wax, move with respect to the element 38. Hence, the element 38 moves upwardly carrying the tube 42 up with it. When the tube 42 ascends, the cam 56 moves upwardly with it and the rollers 74 roll down the cam surfaces 62. This rotates the shafts 71 and the damper blades 72 such that the lower ends of the blades 72 are moved in opposite directions away from one another. The chamber 16 is thereby placed in communication with the room and cold air can flow from the air duct 40, via chamber 16, into the room. The actuator 18 is now as shown in FIG. 7, the rollers 74 being in contact with the flats 66.

As the element 32 cools the reverse action occurs, the spring 68 causing the spindle 36 and the element 38 to descend as the wax contracts. The diffuser thus returns to the condition of FIG. 6 and the flow of cold air is minimised. Thus room temperature is regulated.

In cool or cold atmospheric conditions, heated air flows in the ducting 40 and the wax in the thermally sensitive element 38 expands. However, the spindle 36 cannot move downwardly as its lower end is against the piston of the fixed element 32. Thus the element 38 moves upwardly with respect to the piston of that element, carrying the tube 42 and the cam 56 up with it against spring action.

Figure 8:
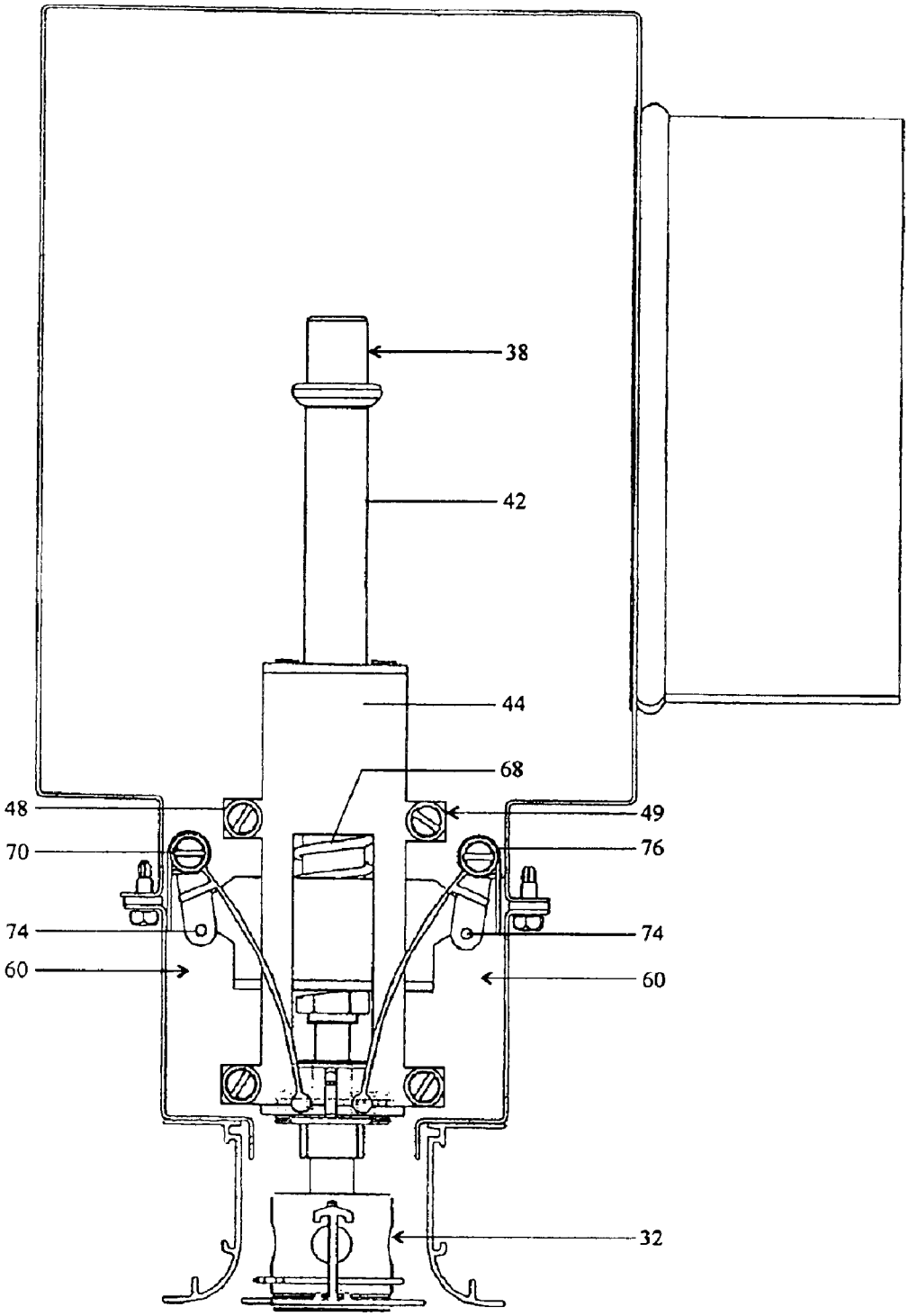
Figure 9:
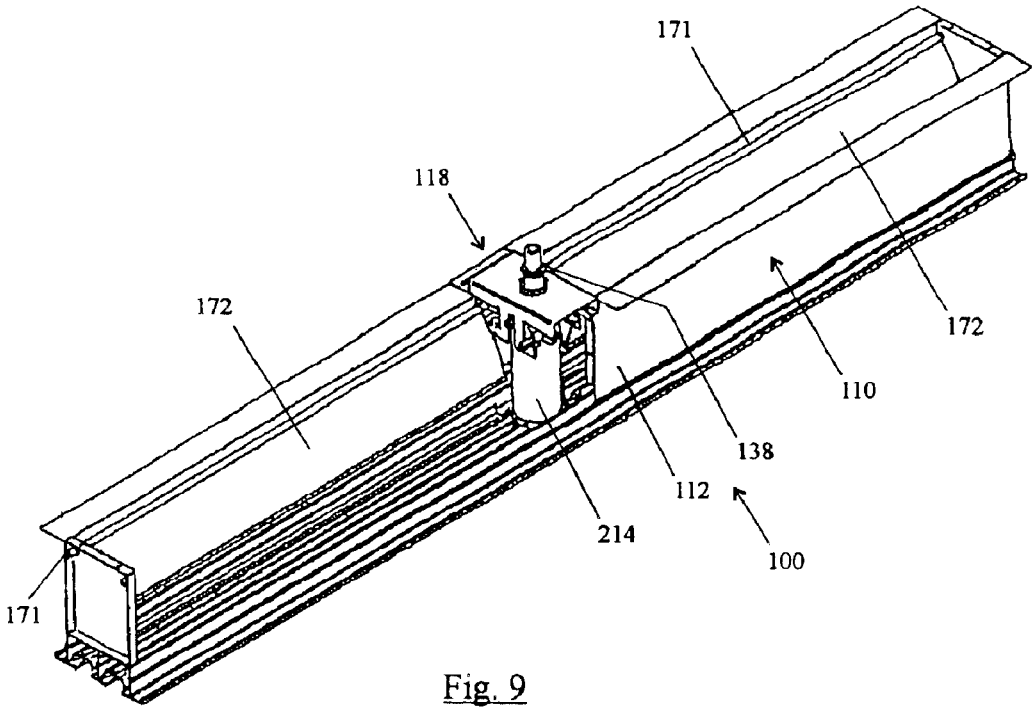
FIG. 9 is a pictorial view of a further diffuser.
Figure 10:
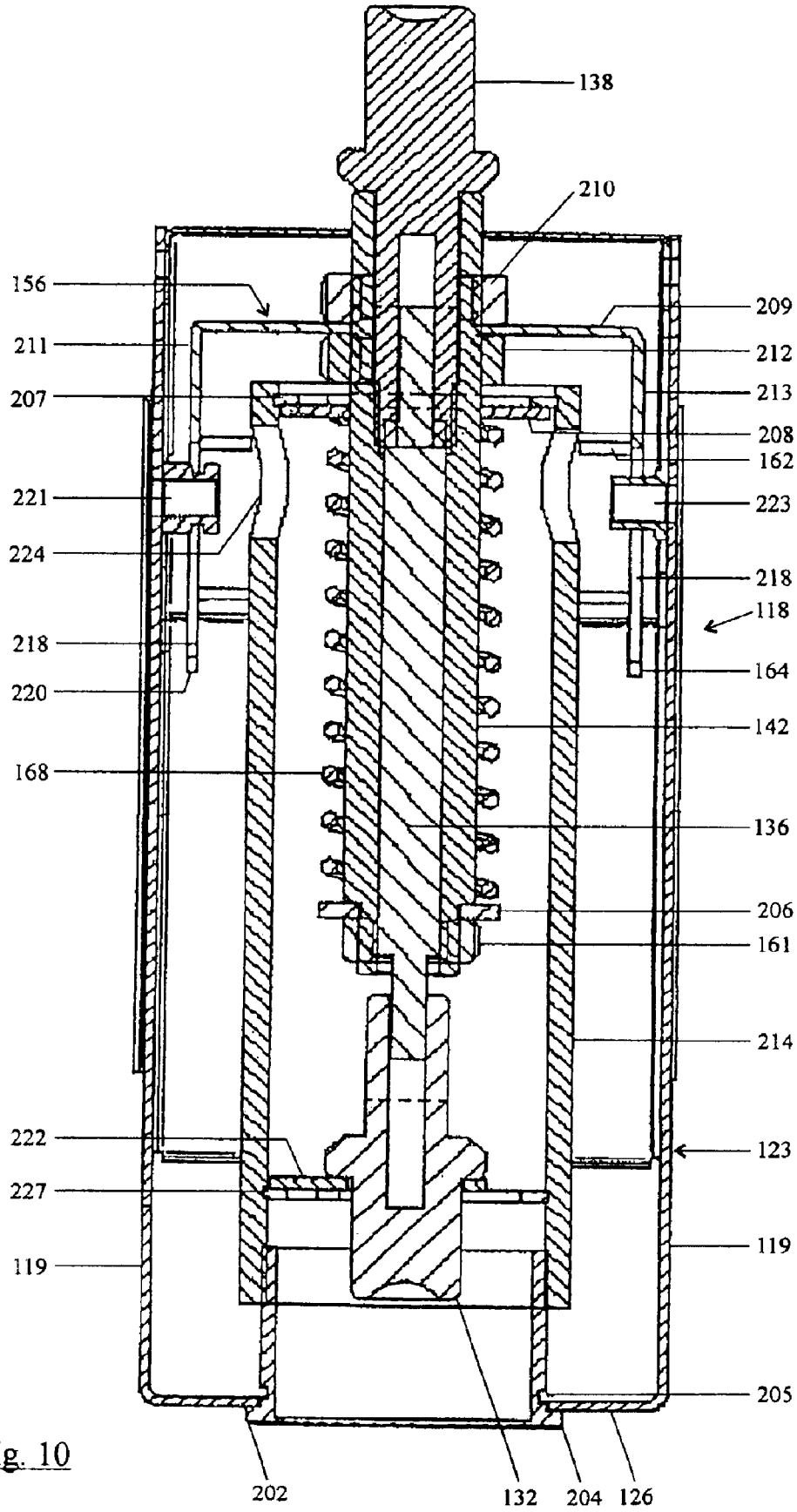
FIG. 10 is a vertical section through the actuator of the diffuser of FIG. 9.
Figure 11:
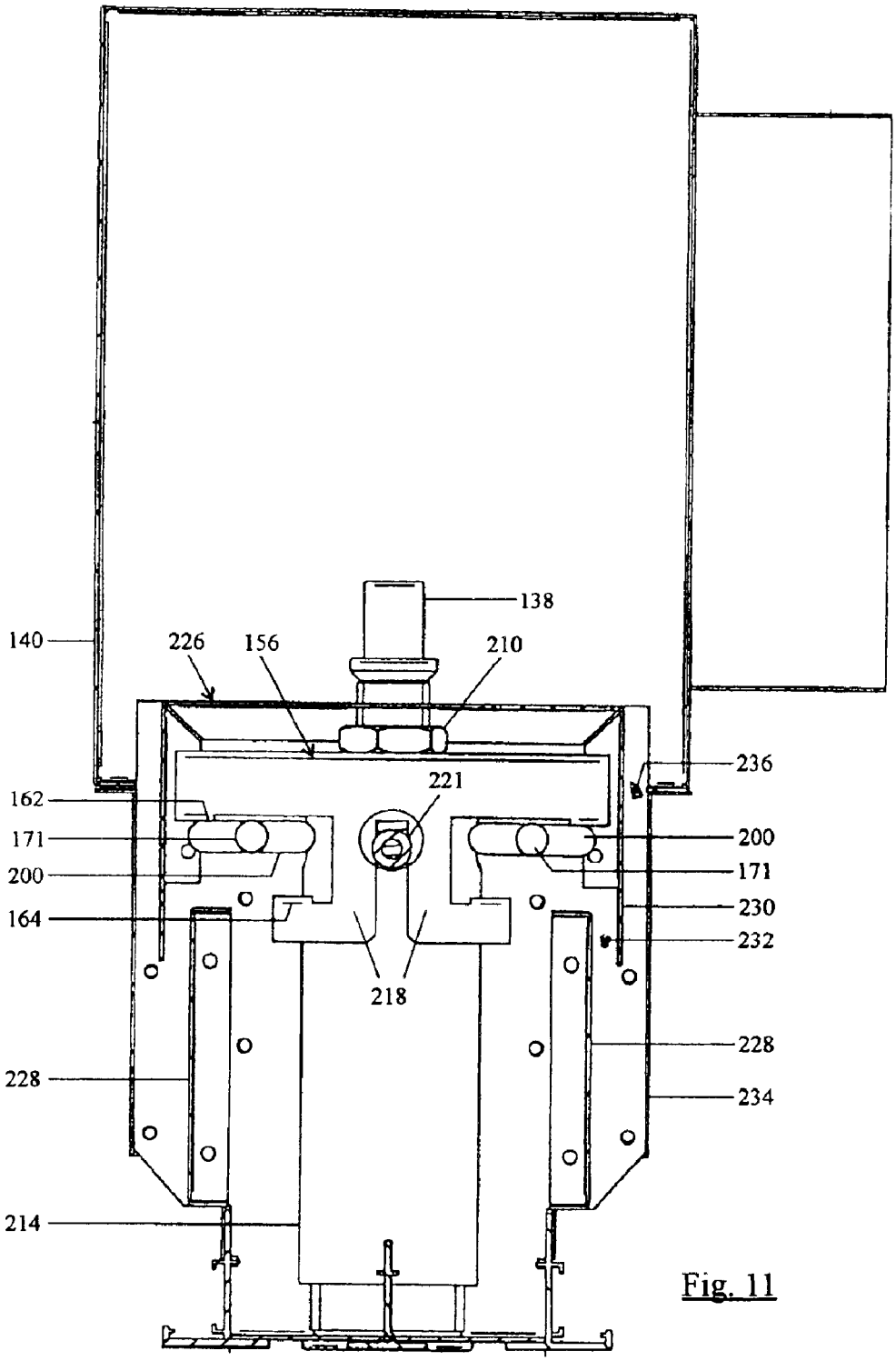
FIG. 11 is a view of the actuator of the diffuser of FIGS. 9 and 10 in the direction of the length of the diffuser.
Figure 12:
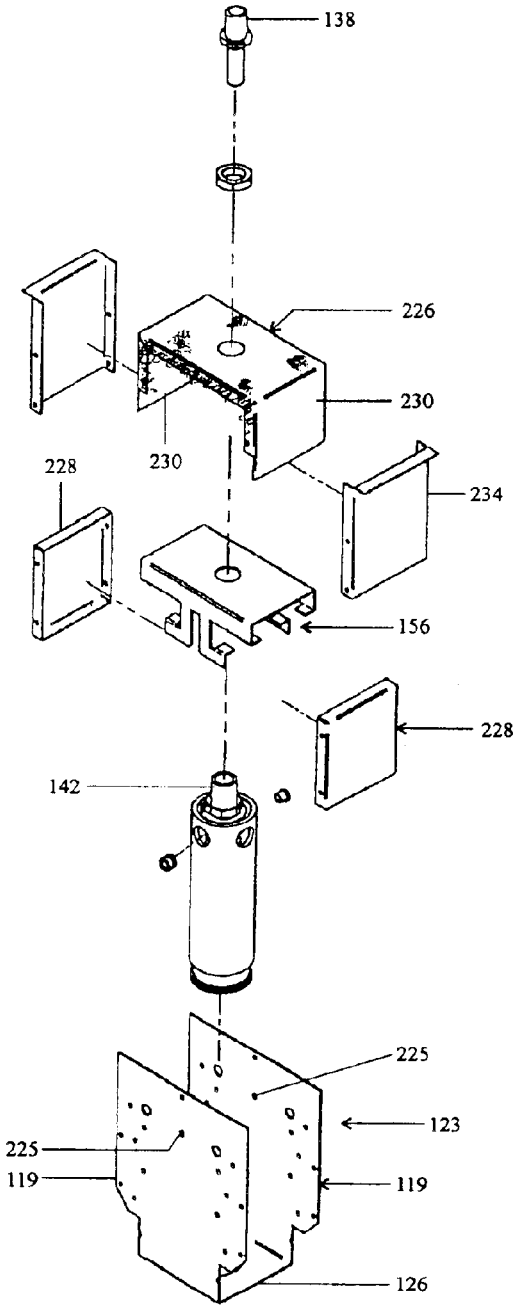
FIG. 12 is an "exploded" view showing the actuator and the surrounding components.
Figure 13:
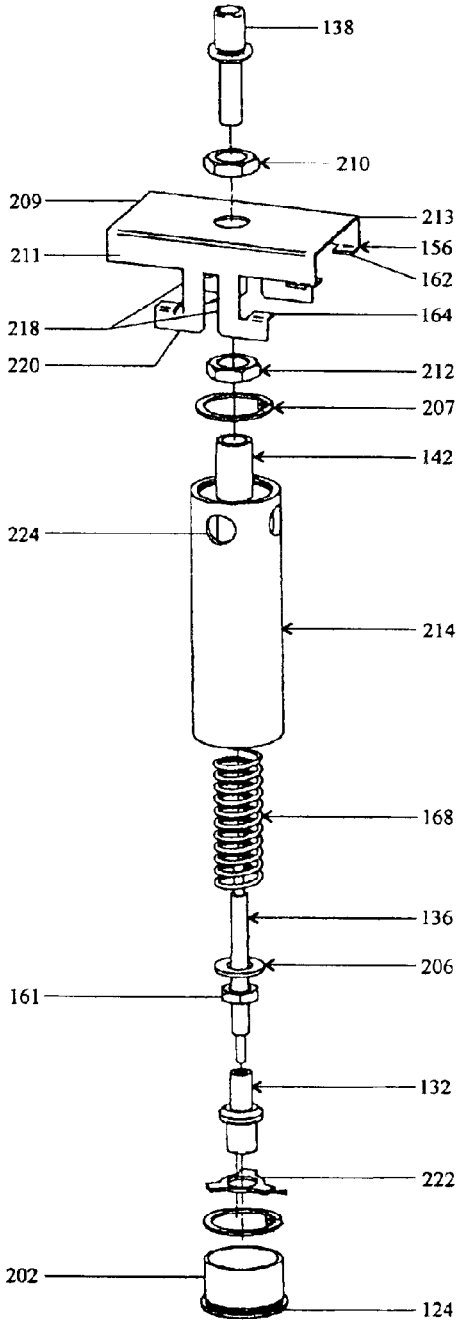
FIG. 13 is an "exploded" view of the actuator.

As shown in FIG. 8, this movement is sufficient to cause the rollers 74 now to bear on the downwardly sloping cam surfaces 64 and not on the cam surfaces 62. In the position shown, the lower ends of the damper blades 72 are close to one another, thereby keeping the flow of heated air from the chamber 16 to the room to a minimum. This is the condition which subsists when the room is warm.

As the element 32 cools with the room, the wax in it contracts. The spring 68 exerts a downward force on the tube 42 and spindle 36 and forces the spindle 36 into the element 32. The cam 56 descends with the tube 42 and the rollers 74 roll up the cam surfaces 64 which, in turn, rotates the shafts 71, and similarly the damper blades 72, such that the lower ends of the blades 72 move apart, thereby increasing the supply of heated air. The blades 72 are now as shown in FIG. 7.

As the room heats up, the wax in the element 32 expands. Its piston thus tends to move upwardly pushing the spindle 36 upwardly. This lifts the element 38, tube 42 and cam 56. Upward movement of the cam 56 allows the rollers 74 to roll inwardly on the cam surfaces 64 which, in turn, rotates the shafts 71 and the damper blades 72 such that the lower ends of the blades 72 are moved towards one another. Supply of heated air from the air ducting 40, via chamber 16, into the room is thus minimised.

The set point at which the actuating mechanism closes off air flow is adjusted by turning the bottom element 32.

Turning now to FIGS. 9 to 17, the diffuser illustrated has some parts in common with the diffuser of FIGS. 1 to 8. Where applicable, therefore, like parts have been designated with like reference numerals increased in magnitude by 100.

The diffuser 100 comprises a casing 110 which has two parallel side plates 112. The actuator, designated 118, is midway between the ends of the casing 110. On each side of the actuator 118 there is a plate 119 (see FIG. 12) which fits between the side plates 112.

Two shafts 171 (see FIG. 11 and FIGS. 14 to 17) pass through each plate 119 and a cam follower 200 is mounted on each shaft 171 for rotation therewith. There are thus two cam followers on each side of the space containing the actuator 118, and four damper blades 172 carried by the four shafts 171 for oscillatory movement about the axes of the shafts.

It will be understood that the actuator 118 can be fitted to the end of the diffuser, in the same way that the actuator 18 is, and thus operate two damper blades 172 only.

The actuator space has a bottom web 126 (see FIG. 12) at the lower end thereof. The web 126 forms part of a bracket 123 which has flanges that constitute the plates 119. A set point adjustment collar 202 protrudes downwardly through a hole in the web 126. The collar 202 includes a ring 204 of a greater size than the hole in the web 126. This ring prevents the collar 202 passing upwardly through the hole in the web. The part of the collar 202 above the web 126 has a circular groove 205 in it. A circlip (not shown) in the groove 205 prevents the collar moving downwardly with respect to the web whilst still permitting it to rotate. The collar 202 is externally threaded and is screwed into internal threading at the lower end of a sleeve 214. The thermally sensitive element 132 is located in the lower end of the sleeve 214.

A tube 142 has a second thermally sensitive element 138 screwed into it. A spindle 136 is within the tube 142 and is in contact with the pistons of the two thermally sensitive elements 132 and 138.

A nut 161 is screwed onto the turned down and threaded lower end of the tube 142. A collar 206 is held in place by the nut 161. The lower end of a spring 168 bears on the collar 206 and presses it against the nut 161.

The upper end of the spring 168 bears on a disc 208 through which the tube 142 passes. A circlip 207 fitted into a groove in the upper end of the sleeve 214 holds the disc 208 in place. Above the disc 208 the tube 142 is externally threaded and two nuts 210, 212 are screwed onto it. Clamped between the nuts is a cam 156.

The cam 156 (see particularly FIG. 13) is of inverted channel shape when viewed in side elevation and has an upper web 209 which is clamped between the nuts 210 and 212, and two flanges 211, 213 which extend downwardly between the sleeve 214 and the vertical walls of the cover. Two columns 218 extend downwardly from each flange 211, 213. A camming element 220 protrudes horizontally from each column 218. Cam surfaces 162 are provided on the underside of each flange 211, 213 and further cam surfaces 164 are provided on the top surfaces of the cam elements 220. The surfaces 162, 164 co-operate with surfaces of the cam followers 200 which are on opposite sides of the axes about which the followers oscillate.

Two guides 221, 223 (FIG. 10) are mounted on the plates 119. The holes through which means for mounting the guides pass are shown at 225 in FIG. 12. The guides 221, 223 are between the columns 218 of the cam 156. The guide 221 is circumferentially grooved and two of the columns 218 enter this groove. The guides prevent undesirable tilting movement of the cam 156 and ensures that it moves in a straight line.

The body of the element 132 is fixed in the lower end of the sleeve 214. More specifically, a spider 222 (FIG. 13) has an inner ring thereof fitted around the body of the element 132. A circlip 227 fitted in an internal groove of the sleeve 214 supports the spider. The spider 222 has gaps between the arms to permit air to pass through from below into the sleeve 214. Near the upper end of the sleeve 214 there are holes 224 through which air can flow out of the sleeve 214.

Because of the manner in which the collar 202 is mounted, it can rotate but cannot move axially. However, rotation of the collar, because of its threaded connection to the sleeve 214, moves the body of the element 132, the spider 222 and sleeve 214 up or down to adjust the start position of the cam 156 and hence the set point of the diffuser.

The sides and top of the space in which the actuator 118 is located are bounded by an inverted channel 226 (FIGS. 11 and 12) through which the element 138 passes. Two inner side plates 228 are secured to the plates 119 and overlap, at their upper ends, with downwardly extending flanges 230 of the channel 226. There are air flow paths 232 (FIG. 11) between the flanges 230 and the side plates 228.

Outwardly of the flanges 230 there are two outer side plates 234 which are also secured to the plates 119. The side plates 234 define air flow paths 236 between themselves and the flanges 230. The upper ends of the paths 236 open into the air duct 140 (see FIGS. 11 and 14 to 17).

Figure 14:
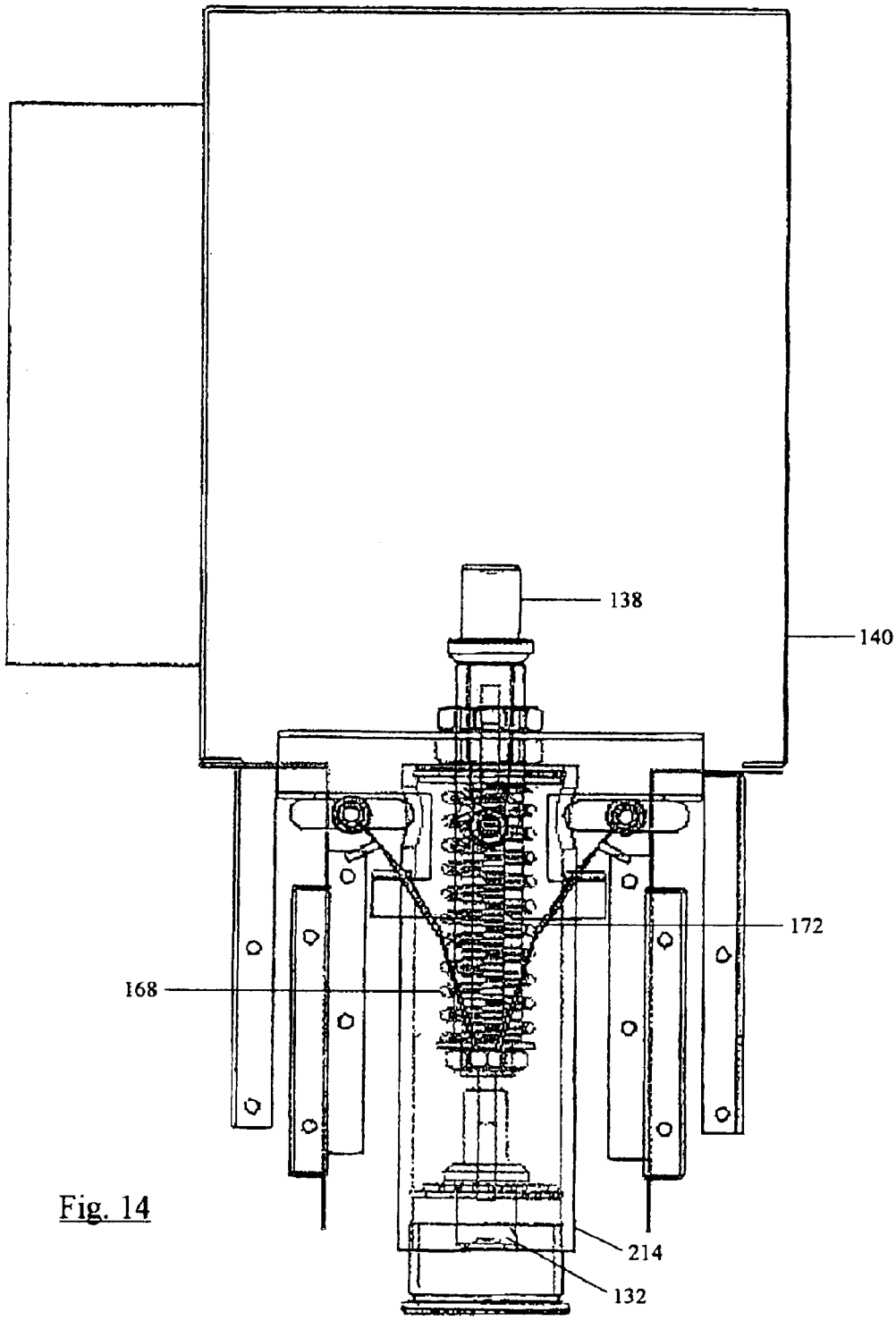
FIGS. 14 to 17 show the diffuser in different operating conditions.

The element 132 senses room temperature and the element 138 detects duct temperature. On the assumption that cooled air is flowing in the ducting 140, the piston of the element 138 is fully retracted. If it is further assumed that the room is cold, then the piston of the element 132 is also fully retracted, the wax in both elements 132, 138 having contracted and possibly solidified. In these conditions the diffuser is as shown in FIG. 14. The spring 168 presses on the upper surface of the flange 206 thus pulling the cam 156 downwardly with the spindle 136 to the maximum extent permitted by the structure.

The cam surfaces 162 bear on the outer ends of the cam followers 200 holding the lower ends of the damper blades 172 close to one another, thereby keeping air flow from the duct 40 to the room to a minimum.

Figure 15:
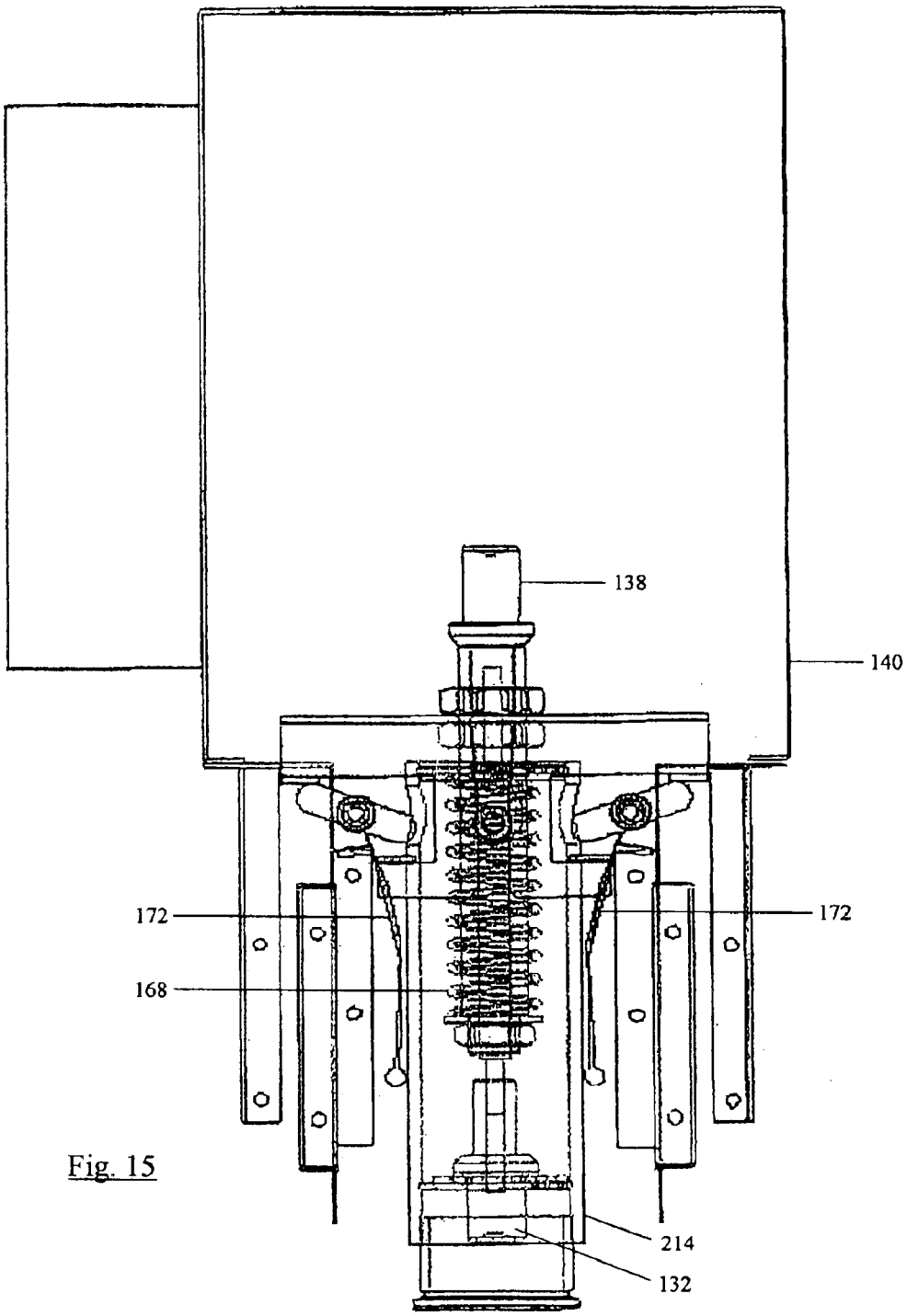

As the room warms up, the wax in the element 132 expands and an upward thrust is exerted on the spindle 136 by the piston of the element 132. The upper end of the spindle 136 is against the piston of the element 138 and the piston of the element 138 cannot, because of the wax, move with respect to the element 138. Hence, the element 138 moves upwardly carrying the tube 142 up with it. When the tube 142 ascends, the cam 156 moves upwardly with it. The surfaces 162 thus move upwardly away from the cam followers 200. Under the influence of gravity acting on the damper blades 172, and air pressure acting on them from above, the damper blades swing down, and thus separate, to permit flow of cold air out of the diffuser and into the room to increase room temperature. The actuator 118 is now as shown in FIG. 15.

As the element 132 cools the reverse action occurs, the spring 168 causing the spindle 136 and the element 138 to descend as the wax contracts. The diffuser thus returns to the condition of FIG. 14 and the flow of cold air is minimised. Thus room temperature is regulated.

In cool or cold atmospheric conditions, heated air flows in the duct 140 and the wax in the thermally sensitive element 138 expands. However, the spindle 136 cannot move downwardly as its lower end is against the piston of the fixed element 132. Thus the body of the element 138 moves upwardly with respect to the piston of that element, carrying the tube 142 and the cam 156 up with it against the action of the spring 168.

Figure 16:
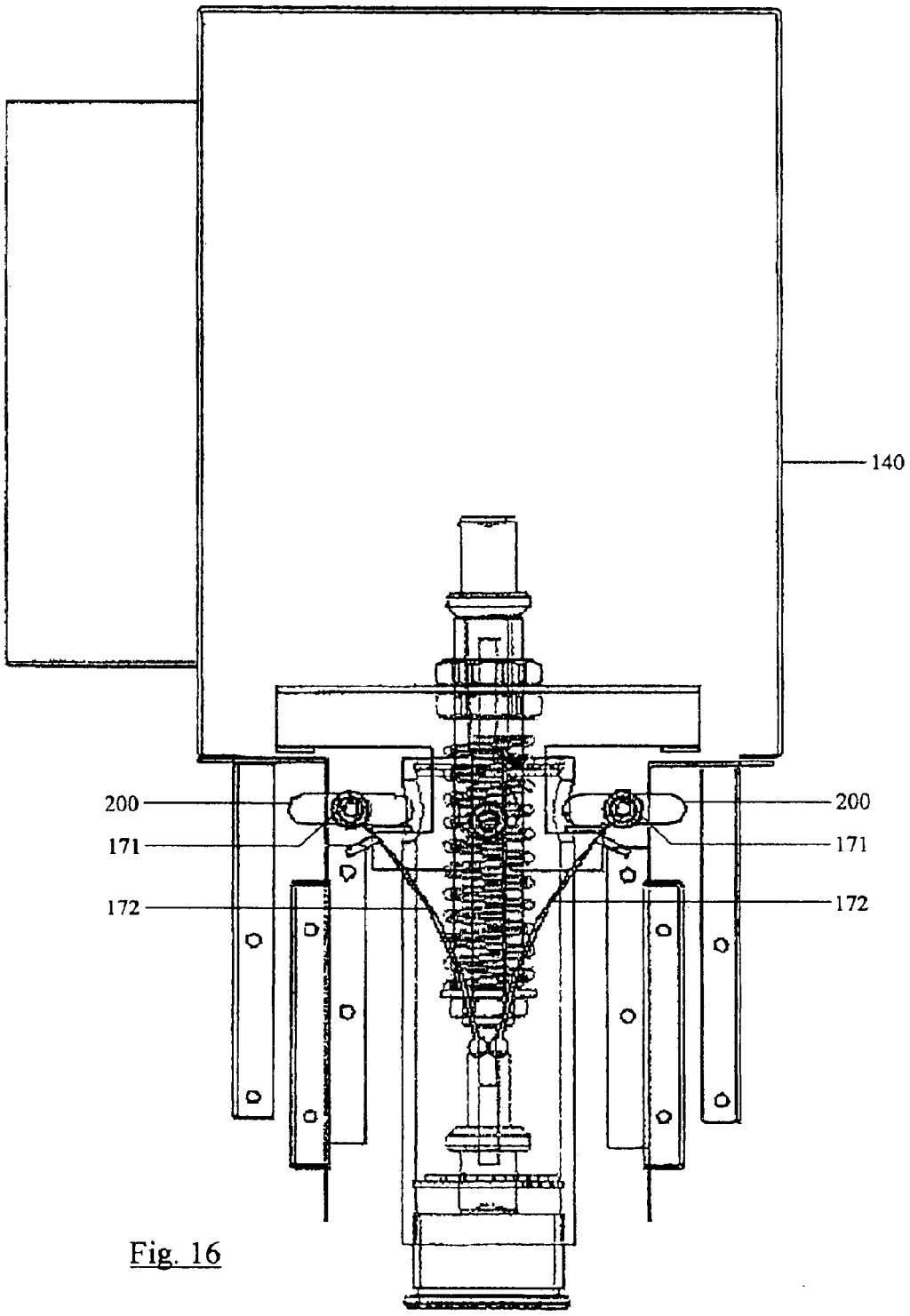

As shown in FIG. 16, this movement is sufficient to cause the cam surfaces 162 away from the cam and to bring the cam surfaces 164 into co-operation with the cam 156. In the position shown, the lower ends of the damper blades 172 are close to one another, thereby keeping the flow of heated air from the duct 140 to the room to a minimum. This is the condition which subsists when the room is warm.

Figure 17:
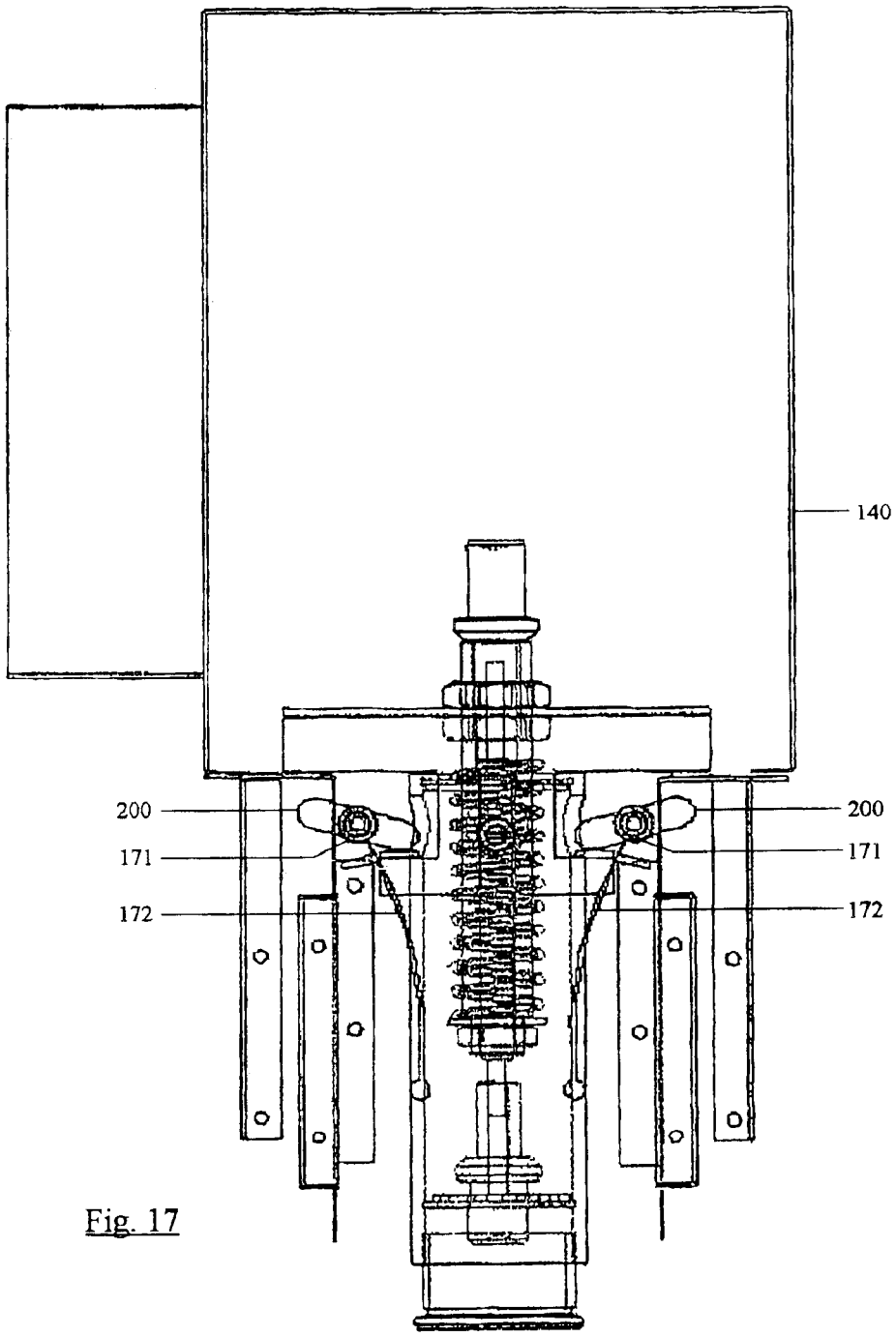

As the element 132 cools with the room, the wax in it contracts. The spring 168 exerts a downward force on the tube 142 and spindle 136 and forces the spindle 136 into the element 132. The cam 156 descends with the tube 142 and permits the cam followers 200 to rotate. This in turn rotates the shafts 171, and similarly the damper blades 172, such that the lower ends of the blades 172 move apart, thereby increasing the supply of heated air. The blades 172 are now as shown in FIG. 17.

As the room heats up, the wax in the element 132 expands. Its piston thus tends to move upwardly pushing the spindle 136 upwardly. This lifts the element 138, tube 142 and cam 156. Upward movement of the cam 156 rotates the cam followers in the direction which displaces the shafts 171 and the damper blades 172 such that the lower ends of the blades 172 are moved towards one another. Supply of heated air from the air duct 140 into the room is thus minimised an the diffuser returns to the condition of FIG. 16.

Airflow downwardly through the flow paths 236 induces a suction effect in the flow paths 232 and draws air from these flow paths. Air is thus drawn from the space encircling the upper end of the sleeve 214 and is replaced by air that flows up the sleeve 214. This air enters the sleeve 214 from its lower end and in so doing flows over the element 132. Hence the element 132 is continually subjected to a flow over it of air at room temperature.

What is claimed is:

1. A diffuser for controlling flow of air in an air conditioning system, the diffuser including a first temperature sensitive element for sensing room temperature variations and including a body and a piston which move relatively to one another in response to temperature variations, a second temperature sensitive element for sensing supply duct temperature variations and including a body and a piston which move relatively to one another in response to temperature variations, an airflow control structure including a damper blade having a first position in which airflow is restricted and a second position in which a greater air flow is permitted, and an actuator for displacing said blade between said first and second positions in response to room temperature variations, said actuator including a cam follower, a cam having first and second cam surfaces and which is displaced by said first element as the piston and body of the first element move relatively to one another with room temperature variations, and means connecting said cam to said second element so that said cam is displaced between a first position in which said first surface and follower co-operate when cooled air is flowing in the duct and a second position in which said second surface and follower co-operate when heated air is flowing in the duct, the arrangement being such that in use said first cam surface displaces the damper blade in the direction which increases air flow as the temperature to which the first element is subjected increases, and said second cam surface displaces the damper blade in the direction which increases air flow as the temperature to which the first element is subjected decreases.

2. A diffuser as claimed in claim 1, wherein said blade is mounted for oscillatory movement about an axis, said cam follower being mounted for oscillatory movement about the same axis and extending on both sides of said axis, said first and second cam surfaces co-operating with surfaces of said follower which are on opposite sides of said axis.

3. A diffuser as claimed in claim 2, and which comprises a pair of diffuser blades mounted for oscillating movement about parallel axes, there being two cam followers and the cam having two first surfaces and two second surfaces for co-operation with the two cam followers.

4. A diffuser as claimed in claim 3, wherein said cam comprises a web by means of which it is secured for movement with said first element, a flange extending downwardly from the web and having said first surfaces thereon and a pair of columns extending downwardly from the web and having said second surfaces thereon, the cam followers being between said first and second surfaces.

5. A diffuser as claimed in claim 4 and including a guide between said columns for ensuring that the cam moves in a straight line.

6. A diffuser as claimed in claim 3, wherein there are pairs of damper blades on each side of the actuator, there being four cam followers each mounted to swing an associated damper blade when the cam moves with variations in the temperature to which said first element is subjected.

7. A diffuser as claimed in claim 6, wherein said cam comprises a depending flange along each edge of the web and pairs of columns extending downwardly from the flange.

8. A diffuser as claimed in claim 6 in which the or each damper blade is urged in one direction by its cam follower and moves in the other direction under the influence of gravity and the force exerted on it by air flowing from the duct to the room.

9. A diffuser as claimed in claim 1 and including a sleeve, said first element being mounted in one end of the sleeve, means defining a first air flow path for feeding air from said duct into a room, means defining a second air flow path for feeding air from the other end of the sleeve to said first flow path, the second flow path leading into the first flow path, the arrangement of said first and second flow paths being such that air flowing in the first flow path draws air from the second flow path and the sleeve thereby causing a flow of room temperature air in said sleeve and across said first element.

10. A diffuser as claimed in claim 1, wherein each cam follower is in the damper form of a roller mounted on a roller carrier, there being spring means for holding the rollers against said cam surfaces.

11. A diffuser as claimed in claim 10, and which comprises a pair of damper blades mounted for oscillating movement about parallel axes, there being two cam followers and the cam having two first surfaces and two second surfaces for co-operation with the two cam followers.

12. A diffuser as claimed in claim 11, wherein said cam is in the form of a plate having the cam surfaces on each of two opposed edges thereof, each first surface of the cam sloping downwardly and intersecting a respective vertical flat at the upper end of the respective flat, and each second surface of the cam sloping upwardly and intersecting the respective flat at the lower end thereof, the first surfaces converging in the direction away from the flats and the second surfaces converging in the direction away from the flats.

13. A diffuser as claimed in claim 1, wherein said means connecting said cam to said second element causes said first and second cam surfaces to change-over and operate selectively on said cam followers depending on whether heated or cold air is flowing in the duct.

* * * * *